United States Patent [19]

Dorsett

[11] Patent Number: 5,050,422

[45] Date of Patent: Sep. 24, 1991

[54] BENDING APPARATUS FOR BENDING A MARGINAL FLANGE ON A WORKPIECE

[75] Inventor: Michael W. Dorsett, Weybridge, Great Britain

[73] Assignee: AB Volvo, Goteborg, Sweden

[21] Appl. No.: 566,399

[22] PCT Filed: Mar. 7, 1989

[86] PCT No.: PCT/SE89/00107

§ 371 Date: Aug. 20, 1990

§ 102(e) Date: Aug. 20, 1990

[87] PCT Pub. No.: WO89/09103

PCT Pub. Date: Oct. 5, 1989

[30] Foreign Application Priority Data

Mar. 21, 1988 [SE] Sweden ..... 881037

[51] Int. Cl.[5] ..... B21J 9/18

[52] U.S. Cl. ..... 72/450; 72/314; 72/452; 29/243.58; 100/271; 100/280

[58] Field of Search ..... 72/312, 313, 314, 315, 72/450, 451, 452; 100/271, 280, 281; 29/243.58

[56] References Cited

U.S. PATENT DOCUMENTS

| | | | |
|---|---|---|---|
| 2,443,573 | 6/1948 | Brundage | 100/271 |
| 2,642,111 | 6/1953 | Bindszus | 29/243.58 |
| 3,058,512 | 10/1962 | Chebuhar et al. | 72/312 |
| 4,346,579 | 8/1982 | Takatsu | 72/314 |
| 4,706,489 | 11/1987 | Dacey, Jr. | 72/314 |

FOREIGN PATENT DOCUMENTS

| | | |
|---|---|---|
| 1155414 | 10/1963 | Fed. Rep. of Germany . |
| 1192611 | 5/1965 | Fed. Rep. of Germany . |
| 1198313 | 8/1965 | Fed. Rep. of Germany . |
| 1445675 | 6/1966 | France . |
| 958671 | 5/1964 | United Kingdom . |

*Primary Examiner*—David Jones

*Attorney, Agent, or Firm*—Young & Thompson

[57] ABSTRACT

Apparatus for bending a margin flange (5) which projects at an angle to a surface of a workpiece (4) against that surface, includes a bending tool (6) which is mounted on a tool holder (7) which by a linkage system (8–13) is connected to a stand (1) which carries the workpiece (4). A drive arrangement (15–24) is connected to the tool holder (7) for movement of the tool holder in relation to the stand (1). The linkage system connecting the tool holder (7) with the stand (1) includes two mutually parallel carrier links (8, 11) each of which is pivotally mounted at one end thereof on a respective journal pin (9, 12) located on the tool holder (7). The other end of one carrier link (8) is pivotally mounted on a journal pin (10) which is fixedly mounted on the stand (1) and which also pivotally carries one end of a connecting link (14), the other end of which is pivotally connected to the other end of the other carrier link (11) by a pin (13). The drive arrangement includes a drive member (15, 17) which is fixedly mounted on the stand and connected to said other carrier link (11) for movement thereof and therewith for movement of the tool holder (7). A camming device (25) is driven by the drive member (15, 17) for coaction with a cam follower element (27) which is attached to the first-mentioned carrier link (8) and projects from the other end of the carrier link in a direction away from the tool holder.

4 Claims, 2 Drawing Sheets

BENDING APPARATUS FOR BENDING A MARGINAL FLANGE ON A WORKPIECE

The present invention relates to apparatus for bending a margin flange, which projects at an angle to a surface on a workpiece, against said surface, said apparatus including a bending tool which is mounted on a tool holder, by means of which a linkage mechanism is connected to a stand which carries the workpiece, and further includes a drive arrangement which is connected to the tool holder in a manner to move said tool holder in relation to the stand.

Apparatus of this kind are previously known and are used, for instance, for bending a margin flange on a metal sheet workpiece around the margin of another metal sheet workpiece, such as to produce a clinching or hemming joint which joins the two workpieces together. Operations of this kind are common, for instance, within the vehicle manufacturing industry, in the production of different vehicle body parts.

The object of the invention is to provide an improved apparatus of the aforedescribed kind. This object is achieved in accordance with the invention in that the linkage mechanism which connects the tool holder to the stand includes two mutually parallel carrier links, each of which is pivotally mounted at one end thereof on a respective journal pin located on the tool holder; in that the other end of the first carrier link is pivotally mounted on a fixed journal pin on the stand, said journal pin also pivotally carrying one end of a connecting link, the other end of which is pivotally connected to the other end of the second carrier link, by means of a pivot pin; and in that the drive arrangement includes a drive member which is attached to the stand and connected to the second carrier link for movement of said link and therewith of the tool holder, and also a camming device which is driven by the drive member and intended for activation of a cam follower which is mounted on the first carrier link and which projects upwardly from the other end of said carrier link in a direction away from the tool holder.

The invention will now be decribed in more detail with reference to the accompanying drawings, in which FIG. 1 is a somewhat schematic side view of a bending apparatus constructed in accordance with one exemplifying embodiment of the invention;

Figure 1:
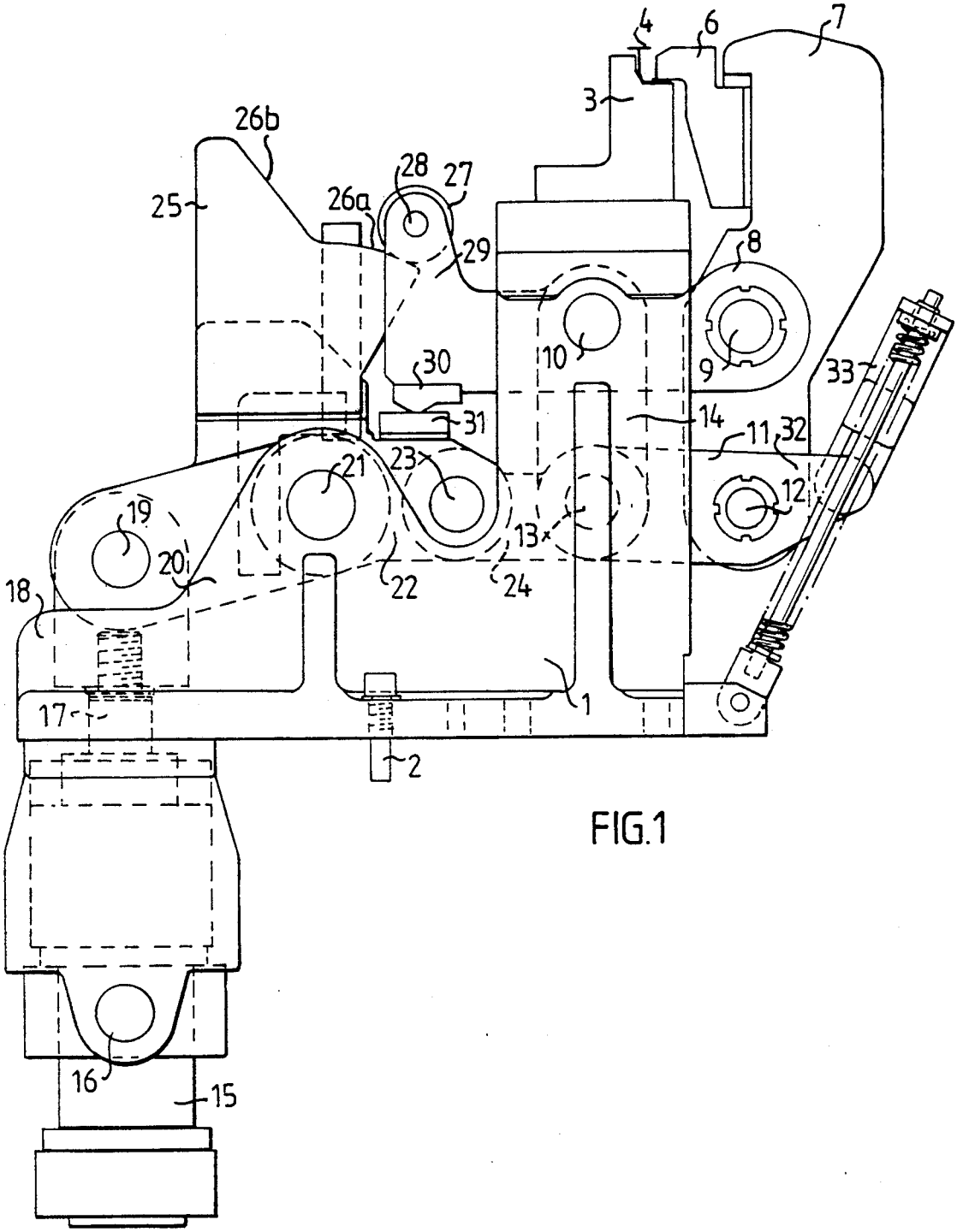

The bending apparatus illustrated in the drawings comprises a stand 1 which is intended to be secured to a supporting surface (not shown) by means of fastener bolts 2, of which only one is shown in FIG. 1. The stand 1 carries a holder 3, on which a workpiece 4 is placed. In the illustrated embodiment, the workpiece 4 comprises a sheet metal rail having the margin flange 5, which, in the starting position illustrated in FIG. 2, extends upwards from the major part of the workpiece 4. FIG. 3 shows the margin flange in a preliminary bent or pre-form state, whereas FIGS. 1 and 4 show the flange subsequent to being fully bent, in which it clinches against an adjacent surface on the workpiece 4. Perpendicularly to the plane of the drawing the workpiece 4 may have considerable length, and may be straight or curved in different directions, the holder 3 naturally being configured to provide support for the workpiece 4 over the whole of its length.

Figure 2:
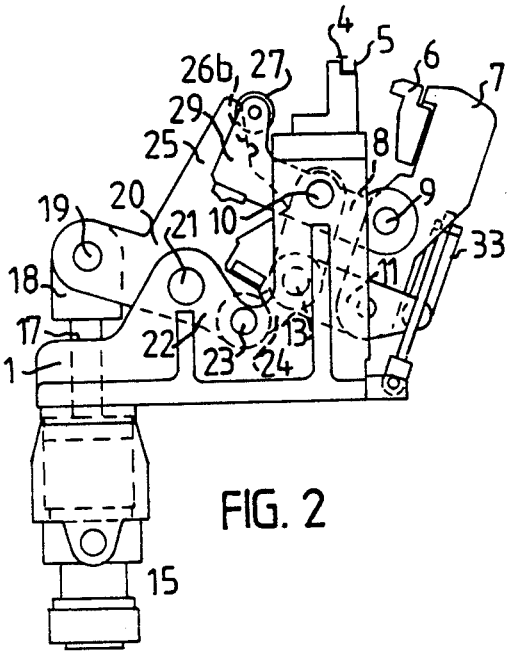
FIG. 2 is a schematic side view of the apparatus of FIG. 1, and shows the apparatus components in their respective starting positions prior to commencing a working sequence.
Figure 3:
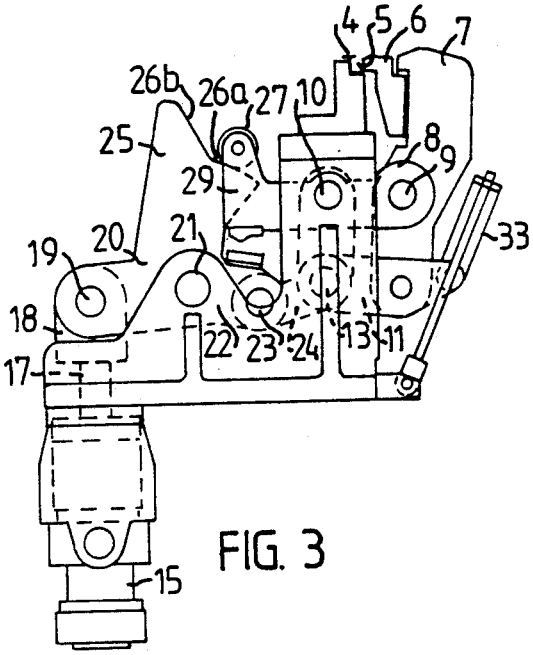
FIG. 3 is a schematic side view of the apparatus of FIG. 1, and shows the apparatus components in their respective preliminary bending positions while carrying out a working sequence.
Figure 4:
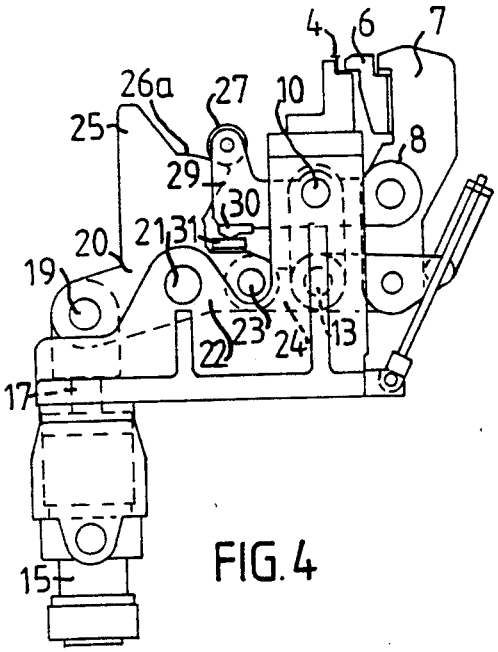
FIG. 4 is a schematic side view of the apparatus of FIG. 1, and shows the apparatus components in their respective bend finishing or clinching positions.

Bending of the margin flange 5 from the starting position illustrated in FIG. 2 to the pre-bend position ilustrated in FIG. 3 and further to the fully bent or clinching position illustrated in FIG. 4, is effected with the aid of a bending tool 6. When seen at right angles to the plane of the drawing, the bending tool 6 has a shape which conforms with the shape of the workpiece 4 and its margin flange 5, so that the tool 6 will co-act with the margin flange 5 over the whole of its length, during a bending operation.

The bending tool 6 is carried by a tool holder 7, which in turn is carried by the stand 1. To this end, there is provided a first carrier link 8, one end of which is pivotally mounted on a journal pin 9 on the tool holder 7 and the other end of which is pivotally mounted on a journal pin 10 on the stand 1. The apparatus also includes a second carrier link 11, one end of which is pivotally journalled on a journal pin 12 on the tool holder 7 and the other end of which is pivotally journalled on a journal pin 13. Also provided is a connecting link 14, one end of which is journalled on the journal pin 10 and the other end of which is journalled on the journal pin 13.

The journal pin 13 is arranged for movement in relation to the stand 1, so as to move the tool holder 7 and the bending tool 6 in a manner to carry out a bending operation, as described in more detail hereinafter. To this end, there is provided a drive arrangement which includes a pressure-medium operated piston-cylinder device 15 which is pivotally suspended in the stand 1 by pivot pins 16. The piston-cylinder device 15 includes a piston rod 17, which carries on its free end, directed upwards in the drawing, an end piece 18. The end piece 18 is pivotally connected by a pivot pin 19 to one arm 20 of a double-arm lever, which is pivotally mounted on a journal pin 21 on the stand 1, and the other arm 22 of which is pivotally connected by means of a pivot pin 23 to one end of a drive link 24, the other end of which is pivotally journalled on the pin 13.

The lever 20, 22 also carries a substantially upwardly extending camming device 25, which is detachably mounted on the lever 20, 22. The camming device 25 presents on the surface thereof distal from the lever 20, 22 a camming surface which comprises a part-circular or curved portion **26*a* and a lifting portion 26*b*. The part-circular portion 26*a* is so configured that its centre of curvature coincides with the geometric axis of the journal pin 21 on which the lever 20, 22 is journalled. In the case of the illustrated embodiment, the lifting part 26*b*** is substantially linear, although it will be understood that other configurations can be used to provide the effect desired, as described in more detail hereinafter.

A cam follower device in the form of a cam follower roller 27 is arranged for co-action with the camming surface **26*a*, 26*b*. The cam follower roller 27 is journalled on a journal pin 28, which is mounted on an arm 29. The arm 29 is connected with the first carrier link 8 and projects therefrom in a direction away from the tool holder 7 on the opposite side of the journal pin 10, as seen from the tool holder 7. The arm 29 is also provided with a downwardly directed shoulder 30, which is intended to co-act with an upwardly directed abutment 31 on the other arm 22** of the lever.

The other carrier link 11 is provided with an arm 32 which projects out on the opposite side of the journal pin 12, as seen from the carrier link 11, and is connected at its outer end with a spring device 32, which is connected at one end thereof to the stand 1 and which is so configured as to urge the end of said arm 32 in an upward direction. This means that the force exerted by the spring device 33 will act on the cam follower roller 27 in a direction towards the camming surface comprising the part-circular portion 26*a* and the lifting portion 26*b*.

A working sequence in which the margin flange 5 is bent against the workpiece 4 will now be described with reference to FIGS. 2–4, which illustrate the various positions of the apparatus components during said working sequence.

FIG. 2 illustrates the starting position, in which the bending tool 6 is spaced from the margin flange 5 on the workpiece 4, in which position the piston rod 17 is extended to a maximum from the piston-cylinder device 15 and the double-arm lever 20, 22 has therewith been rotated clockwise (seen on the drawing) about the journal pin 21. The camming device 25 ha been swung together with the lever 20, 22, and the cam follower roller 27 has been moved therewith, upwardly along the lifting part 26*b*, therewith causing the arm 29 and the first carrier link 8 to be swung anti-clockwise (seen on the drawing) about the journal pin 10. The spring device 33 therewith holds the cam follower roller 27 pressed against the lifting part 26*b* of the camming device. The drive link 24 holds the pin 13 in a given position.

When carrying out a working sequence, the piston rod 17 is withdrawn into the piston-cylinder device 15, primarily to the pre-bend position illustrated in FIG. 3. The lever 20, 22 is therewith swung anti-clockwise around the journal pin 21, therewith moving the cam follower roller 27 along the lifting part 26*b*, down to the part-circular portion 26*a* of the camming surface of the camming device 25. This enables the arm 29 and the first carrier link 8 to be swung anti-clockwise around the journal pin 10. The journal pin 9 will therewith move the tool holder 7 and the bending tool 6 upwards, while, at the same time, the drive link 24 will move the pin 13 to the right in the Figure, to the position illustrated in FIG. 3, wherewith the tool holder 7 and the bending tool 6 are swung about the journal pin 9, so that the tool 6 will be moved to the left, to the pre-bend position illustrated in FIG. 3. The tool 6 will then bear against the margin flange 5 and bend said flange.

Continued withdrawal of the piston rod 17 into the piston-cylinder device 15 initiates essentially the movements described in the aforegoing. Thus, the bending tool 6 is moved further to the left by the tool holder 7, such as to bend the margin flange 5 to the clinching position illustrated in FIG. 4. In this case, the cam follower roller 27 moves along the part-circular portion 26*a*, meaning that the arm 29 and the first carrier link 8 will retain their respective positions. The drive link 24, on the other hand, moves the pin 13 to the right, to the position shown in FIG. 4, and the bending tool 6 and the tool holder 7 are moved to the left in conjunction with this movement of the pin. At the end of the withdrawal movement of piston rod 17 into the piston-cylinder device 15, the shoulder 30 located on the arm 29 will be in abutment with the abutment 31 located on the other arm 22 of the lever. During the final part of movement of the piston rod 17 into the cylinder, the abutment 31 will urge the shoulder 30 upwards, so that the arm 29 and the first carrier link 8 are pivoted slightly clockwise about the journal pin 10. This causes the tool holder 7 and and the bending tool 6 to be moved substantially downwards, so as to finally bend the margin flange 5 into clinching engagement with the workpiece 4. The bending sequence is then complete and the apparatus components can be returned to their respective FIG. 2 starting positions, by extending the piston rod 17 from the piston-cylinder device 15. The apparatus is then ready for the next working sequence.

The invention is not restricted to the aforedescribed exemplifying embodiment, since modifications thereto can be made within the scope of the following claims. For example, the lifting part 26*b* of the camming device 25 can be given a configuration which is commensurate with desired movement of the tool holder 7 and the bending tool 6. The lifting part 26*b* may be replaced with a lifting part which extends from the part-circular portion 26*a* obliquely inwards towards the journal pin 21, such that the bending tool 6 and the tool holder 7 will be positioned at a higher level than the workpiece 4 in the starting positions thereof. This can be desirable for different reasons, for instance when several bending apparatus are to work in mutually adjacent and mutually sequential relationship, therewith enabling work to be carried out without the apparatus obstructing one another.

I claim:

1. Apparatus for bending a margin flange (5) which projects at an angle to a surface of a workpiece (4) against said surface, the apparatus including a bending tool (6) which is mounted on a tool holder (7) which, by means of a linkage system (8–13) is connected to a stand (1) which carries the workpiece (4), and further includes a drive arrangement (15–24) which is connected to the tool holder (7) for movement of the tool holder in relation to the stand (1), characterized in that the linkage system connecting the tool holder (7) with the stand (1) includes two mutually parallel carrier links (8, 11) each of which is pivotally mounted at one end thereof on a respective journal pin (9, 12) located on the tool holder (7); in that the other end of one said carrier link (8) is pivotally mounted on a journal pin (10) which is fixedly mounted on the stand (1) and which also pivotally carries one end of a connecting link (14), the other end of which is pivotally connected to the other end of the other said carrier link (11) by means of a pin (13); and in that the drive arrangement includes a drive member (15, 17) which is fixedly mounted on the stand and connected to said other carrier link (11) for movement thereof and therewith for movement of the tool holder (7), and also a camming device (25) operationally connected with and driven by the drive member (15, 17) for coaction with a cam follower element (27) which is attached to said one carrier link (8) and projects from the other end of said one carrier link in a direction away from the tool holder.

2. Apparatus according to claim 1, characterized in that the drive member is a pressure-medium operated piston-cylinder device (15) which is pivotally attached to the stand (1) and connected to the second carrier link (11) by means of a double-arm lever (20, 22) which is pivotally mounted on a journal pin (21) on the stand (1), and one arm (20) of which is pivotally connected to the piston rod (17) of the piston-cylinder device (15) and the other arm (22) of which is pivotally connected to one end of a drive link (24), the other end of which is pivotally connected to the second carrier link (11).

3. Apparatus according to claim 2, characterized in that the camming device (25) is detachably mounted on the double-arm lever (20, 22) and is configured with a camming surface (26*a*, 26*b*) for co-action with the cam follower element (27), said camming surface including a part-circular portion (26*a*) whose center of curvature coincides with the journal pin (21) on which the double-arm lever (20, 22) is journalled, and further includes a lifting part (26*b*) for moving the cam follower element (27) in relation to the journal pin (21) on which the double-arm lever (20, 22) is journalled.

4. Apparatus according to claim 1, further comprising a spring device (33) urging the cam follower element (27) in a direction towards the camming device (25).

* * * * *